US011142803B2

(12) United States Patent
Pongiglione et al.

(10) Patent No.: US 11,142,803 B2
(45) Date of Patent: Oct. 12, 2021

(54) BLAST FURNACE STOCKHOUSE ARRANGEMENT

(71) Applicant: PAUL WURTH S.A., Luxembourg (LU)

(72) Inventors: Giovanni Pongiglione, Genoa (IT); Aldo Castellani, Genoa (IT)

(73) Assignee: PAUL WURTH S.A., Luxembourg (LU)

( * ) Notice: Subject to any disclaimer, the term of this patent is extended or adjusted under 35 U.S.C. 154(b) by 483 days.

(21) Appl. No.: 16/065,398

(22) PCT Filed: Dec. 21, 2016

(86) PCT No.: PCT/EP2016/082250
§ 371 (c)(1),
(2) Date: Jun. 22, 2018

(87) PCT Pub. No.: WO2017/108998
PCT Pub. Date: Jun. 29, 2017

(65) Prior Publication Data

US 2018/0371559 A1 Dec. 27, 2018

(30) Foreign Application Priority Data

Dec. 22, 2015 (EP) ..... 15202150

(51) Int. Cl.
*C21B 7/20* (2006.01)
*F27B 1/20* (2006.01)
(Continued)

(52) U.S. Cl.
CPC ..... *C21B 7/20* (2013.01); *F27B 1/20* (2013.01); *F27D 3/10* (2013.01); *B07B 13/14* (2013.01); *C21B 5/008* (2013.01)

(58) Field of Classification Search
CPC B07B 13/14; B07B 13/16; C21B 7/20; C21B 5/008; F27B 1/20; F27D 3/10
See application file for complete search history.

(56) References Cited

U.S. PATENT DOCUMENTS

2011/0282494 A1* 11/2011 Tockert ..... F27D 3/0025 700/274

FOREIGN PATENT DOCUMENTS

JP S58087856 U 6/1983
JP S61149409 A 7/1986
(Continued)

OTHER PUBLICATIONS

KR Office Action dated Sep. 17, 2018 re: Application No. KR 10-2018-7019364, pp. 1-15, citing: JP 2014-162989, KR 20-2000-0012233 and KR 10-2013-0034293.
(Continued)

*Primary Examiner* — Charles A Fox
*Assistant Examiner* — Kalyanavenkateshware Kumar
(74) *Attorney, Agent, or Firm* — Cantor Colburn LLP

(57) ABSTRACT

A stockhouse arrangement for a metallurgical furnace includes a set of storage bins granular material; a material feeding device associated with the set of storage bins, the material feeding device being arranged above the set of storage bins and allowing to selectively fill each of the storage bins with granular material; and a raw material feed system to convey raw granular material to the material feeding device, wherein a respective weighing hopper is arranged downstream of each storage bin and including an outlet associated with a feeding gate, and a charge conveying system is provided for collecting and conveying material selectively discharged from the weighing hoppers through their respective feeding gate, the material feeding device being configured to screen raw granular material arriving
(Continued)

from the raw material feed system such that only material with desired granulometry is forwarded to the respective bin(s).

14 Claims, 5 Drawing Sheets

(51) Int. Cl.

| | |
|---|---|
| ***F27D 3/10*** | (2006.01) |
| *C21B 5/00* | (2006.01) |
| *B07B 13/14* | (2006.01) |

(56) References Cited

FOREIGN PATENT DOCUMENTS

| | | | |
|---|---|---|---|
| JP | 2004010980 | A | 1/2004 |
| JP | 2004346414 | A | 12/2004 |
| JP | 2014162989 | A | 9/2014 |
| KR | 2020000012233 | U | 7/2000 |
| KR | 1020130034293 | A | 4/2013 |
| WO | 2010086379 | A1 | 8/2010 |

OTHER PUBLICATIONS

International Preliminary Report on Patentability dated Feb. 22, 2017 re: Application No. PCT/EP2016/082250, pp. 1-15, citing: JP 2014 162989 A, JP 2004 019080 A and WO 2010/086379 A1.

International Search Report dated Feb. 22, 2017 re: Application No. PCT/EP2016/082250, pp. 1-3, citing: JP 2014 162989 A, JP 2004 019080 A and WO 2010/086379 A1.

Written Opinion dated Feb. 22, 2017 re: Application No. PCT/EP2016/082250, pp. 1-6, citing: JP 2014 162989 A, JP 2004 019080 A and WO 2010/086379 A1.

JP Office Action dated Nov. 6, 2018 re: Application No. JP 2018-530848, pp. 1-12, citing: JP 2004-346414, JP S61-149409, JP S58-087856.

* cited by examiner

BLAST FURNACE STOCKHOUSE ARRANGEMENT

FIELD OF THE INVENTION

The present invention generally relates to the field of iron making equipment and more specifically to a stockhouse arrangement for a metallurgical furnace, in particular a blast furnace.

BACKGROUND OF THE INVENTION

As it is well known, the blast furnace charging system consists of two main areas, the stockhouse system and the top charging equipment. The function of the stockhouse system is the weighing, batching and delivering of the recipe of raw materials to the top charging equipment, which is installed above the blast furnace. The top charging equipment, in turn, serves the function of delivering blast furnace raw materials to the furnace top and distributing these materials into the furnace.

The stockhouse comprises a set of storage bins that are usually fed by a feed system with conveyor belt. The raw materials are drawn from the storage bins by vibrating feeders and screens into weighing hoppers, optionally via belt conveyors. The weighing hoppers, in turn, discharge the materials onto the main conveyor. The weighing hoppers are programmed to meter the raw materials in a desired order onto the main conveyor belt to the top of the furnace. Fines are also evacuated at the weighing hoppers.

A conventional stockhouse is for example identified with reference numeral 10 in FIG. 1 of WO 2010/086379.

Automation of stockhouses has significantly increased production capability, improved operating efficiency, and eliminated operating variances caused by personnel and equipment. In practice, a modern, automated stockhouse can be quite complex. The stockhouse itself may be fed by conveyors, which in turn discharge onto tripping conveyors to distribute materials to various bins. The layout of conveyors and equipment in the stockhouse can be arranged in numerous ways.

A concern for the Blast Furnace operator is material segregation occurring in the stockhouse. It has been observed that grain size distribution within a batch of material discharged from a weighing hopper is not constant but obeys to certain rules deriving from the way the material segregates inside the stockhouse storage bins during filling and emptying operations.

SUMMARY OF THE INVENTION

The present invention concerns a material storage arrangement in a stockhouse for a metallurgical furnace comprising:

a set of storage bins for granular material;

a material feeding device associated with the set of storage bins, the material feeding device being arranged above the set of storage bins and allowing to selectively fill each of the storage bins with granular material;

a raw material feed system to convey raw granular material to the material feeding device;

a respective weighing hopper arranged downstream of each storage bin and comprising an outlet associated with a feeding gate;

a charge conveying system for collecting and conveying material selectively discharged from the weighing hoppers through their respective feeding gates.

According to the invention, the material feeding device is configured to screen raw granular material arriving from said raw material feed system such that only material with desired grain size granulometry is forwarded to the respective bin(s). The present invention thus provides a stockhouse arrangement (also simply referred to as stockhouse) where material is sized and screened before storage, reducing or alleviating the need for vibrating screens below each storage bin, as is the case in a conventional stockhouse arrangement.

The undersized material screened out by the material feeding device is preferably collected in a fines collecting bin associated with said material feeding device.

In one embodiment, the material feeding device comprises a screen unit receiving granular material from the raw material feed system, the screen unit comprising one or more screens of predetermined mesh size and being configured to filter out undersized granular material and forward oversized, desired material to the respective storage bins. A vibrator is typically associated with the one or more screens.

In general, the material feeding device may comprise intermediate conveyor means configured for transporting material with desired granulometry from the screen unit to the respective bins, and preferably for transporting undersized material to the fines collecting bin. In practice, the material feeding device advantageously allows to selectively direct material with desired granulometry (i.e. from the screen unit) to one selected bin of the set of bins, i.e. it is preferably designed to perform a distributing function that is associated with one storage bin at a time.

The material feeding device is advantageously installed in a generally central location with respect to the set of bins, with the fines collecting bin.

The material feeding device may comprise a rotatable platform arranged above the set of storage bins, on which the screen unit is supported. The fines collecting bin is preferably arranged below the rotatable platform, to collect fines falling from below the screen unit.

Alternatively, the material feeding device may comprise a movable, bi-directional conveyor belt that receives material with desired granulometry from the screening unit. The movable, bi-directional conveyor belt is arranged above the storage bins. It is configured so that its ends can be aligned with respective storage bins in a row, to deliver material therein, and so that it can be moved along the row of storage bins, in order to be able to deliver material to all of the bins.

To improve the performance of the present material storage arrangement, it is of advantage to design the storage bins so as to avoid free material fall therein. Each storage bin may, e.g., comprise one or more material guide elements forming one or more path(s) for guiding material from the bin's top region to a lower region thereof, the path(s) being designed to reduce the velocity of the falling material. The use of such material guide elements avoids degradation of the already screened material, which is beneficial to an optimum operation of the present material storage arrangement. The material guide elements may take any appropriate form to perform their function of preventing free material fall, e.g., chutes, stairways or ladders guiding the material from the top region of the bin towards, e.g., the middle region.

Similarly, the weighing hoppers are also preferably designed to avoid material degradation, and may be configured to mix the incoming material, avoiding separation of different grain size. For example, the weighing hopper may include diverter bars arranged inside each weighing hopper, to create different flow channels avoiding the rat hole effect during the emptying phase, which in conventional installations amplify the segregation on the main charging.

During the filling of the weighing hopper, it avoids the free fall of the material, hence reducing the possible material degradation and limiting the centrifugal force on the grains, which is the cause for the segregation.

It shall be appreciated that these measures provide a synergetic contribution that alleviates material segregation and degradation effects. Screened and sized material is readily available in the storage bins, the storage bins and weighing hoppers being designed to avoid material degradation.

The inventive stockhouse hence permits a better control of the material granulometry. This allows blast furnace operators to have a better control on the relative permeability of the material inside a batch once it is discharged inside the furnace (in addition to the ability of controlling the BF charge distribution via the top charging device).

Furthermore, avoiding material free fall into bins and weighing hoppers with consequent grain size degradation and fines generation in accordance with the present invention, leads to more compact designs of stockhouses, leading to substantial savings in terms of number of machines required, time for batch preparation and de-dusting capacity.

Also to be noted is the possibility of retrofitting. Existing installations can be modified without difficulties to conform to the present stockhouse arrangement.

The proposed stockhouse configuration leads up to a significant reduction in investment costs, through the reduction of number of vibroscreens and of steel structure weights.

In comparison with the existing systems installed in some blast furnace stockhouses, the proposed system is more flexible and adaptable, and developed to facilitate maintenance thereof.

For the sake of exemplification, the conventional stockhouse scheme:

belt conveyor—bin—vibrofeeder—screen—weighing hopper—gate can be advantageously replaced with the present stockhouse design:

screen—bin—gate—weighing hopper—gate

The above and other embodiments of the present invention are also recited in the appended dependent claims.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
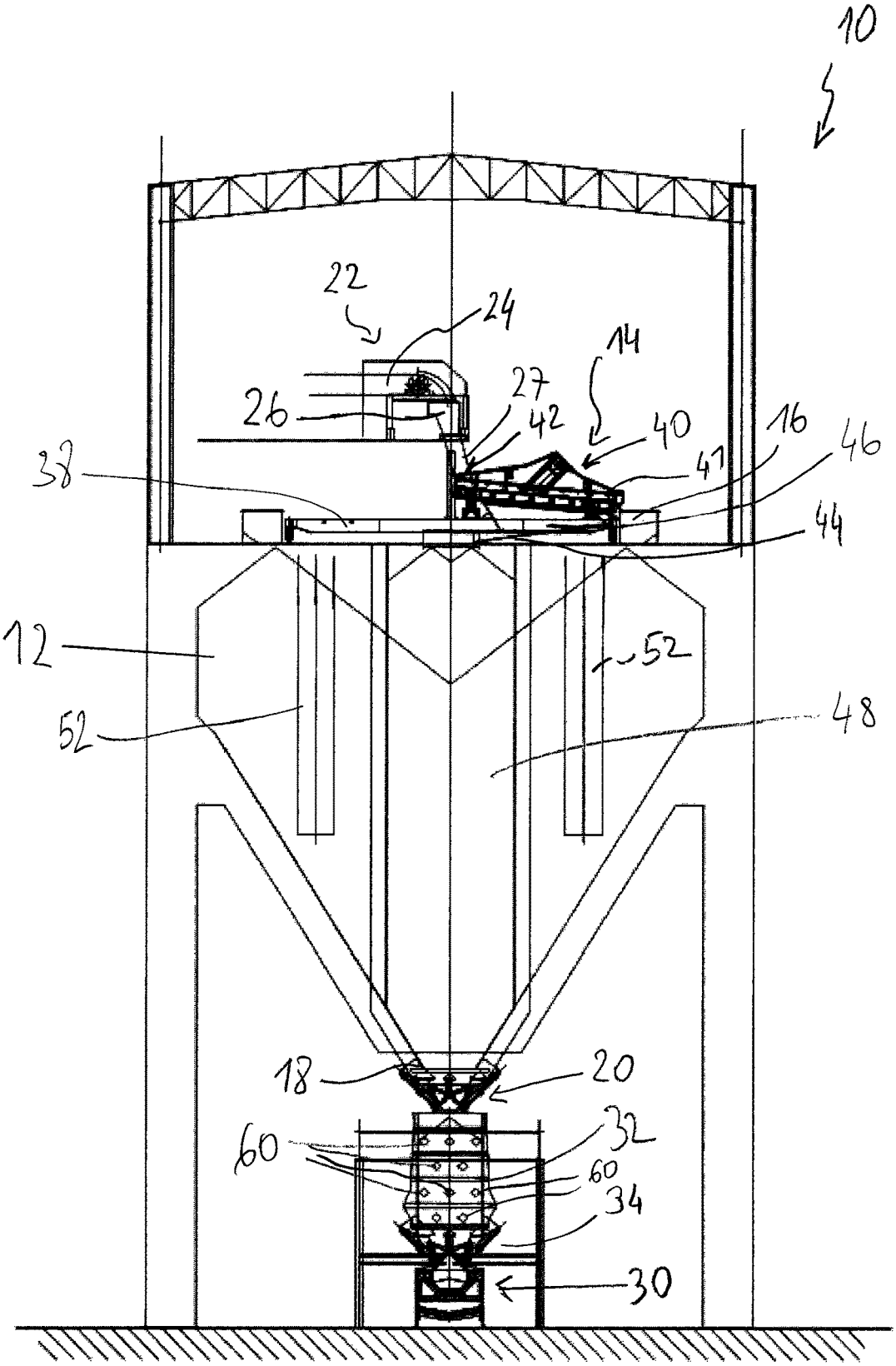
FIG. 1: is a cross-sectional view through an embodiment of the present stockhouse.
Figure 2:
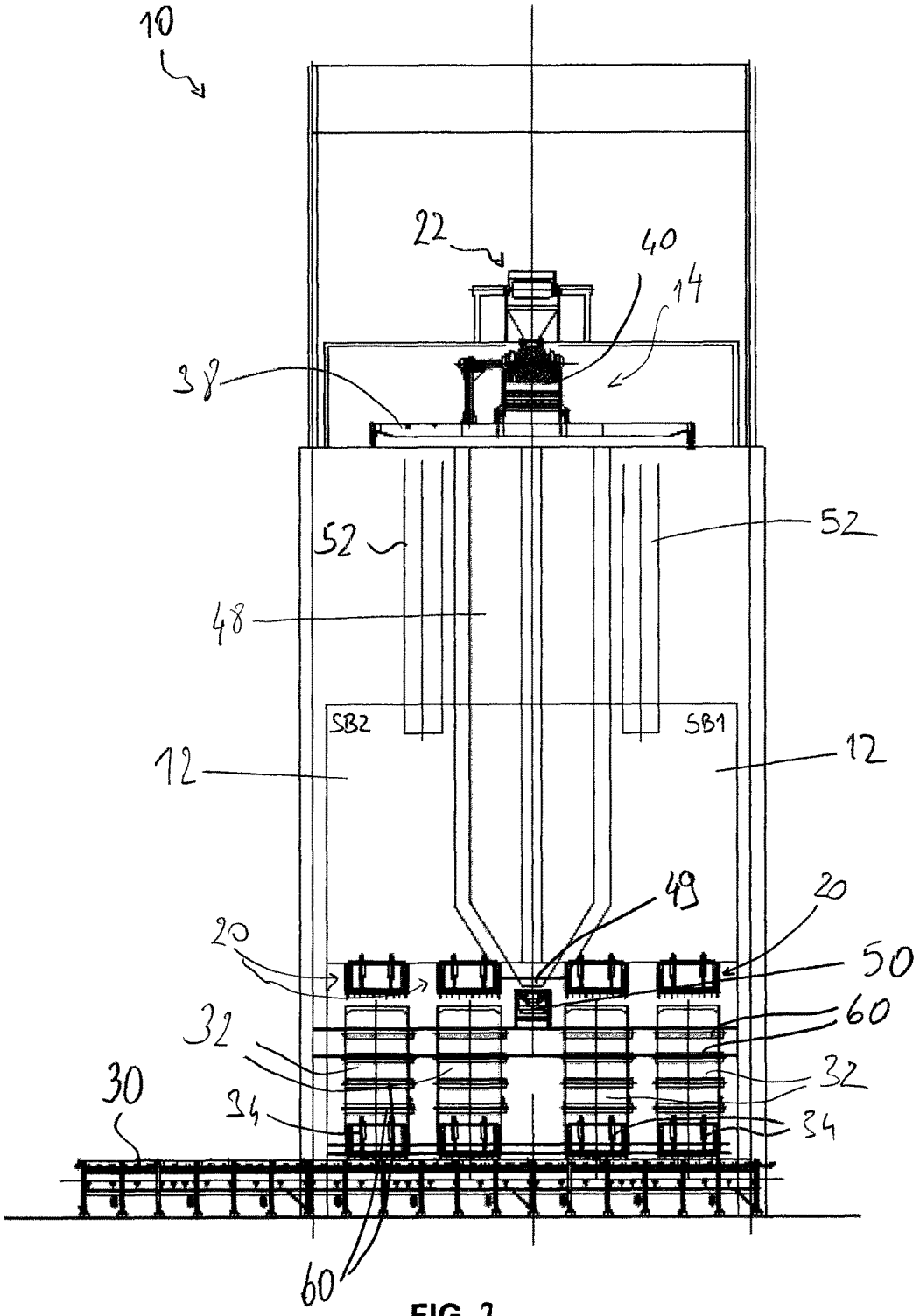
FIG. 2: shows two sectional views (a, b) of the stockhouse of FIG. 1, along lines B-B and A-A, respectively, and (c) a top view.
Figure 3:
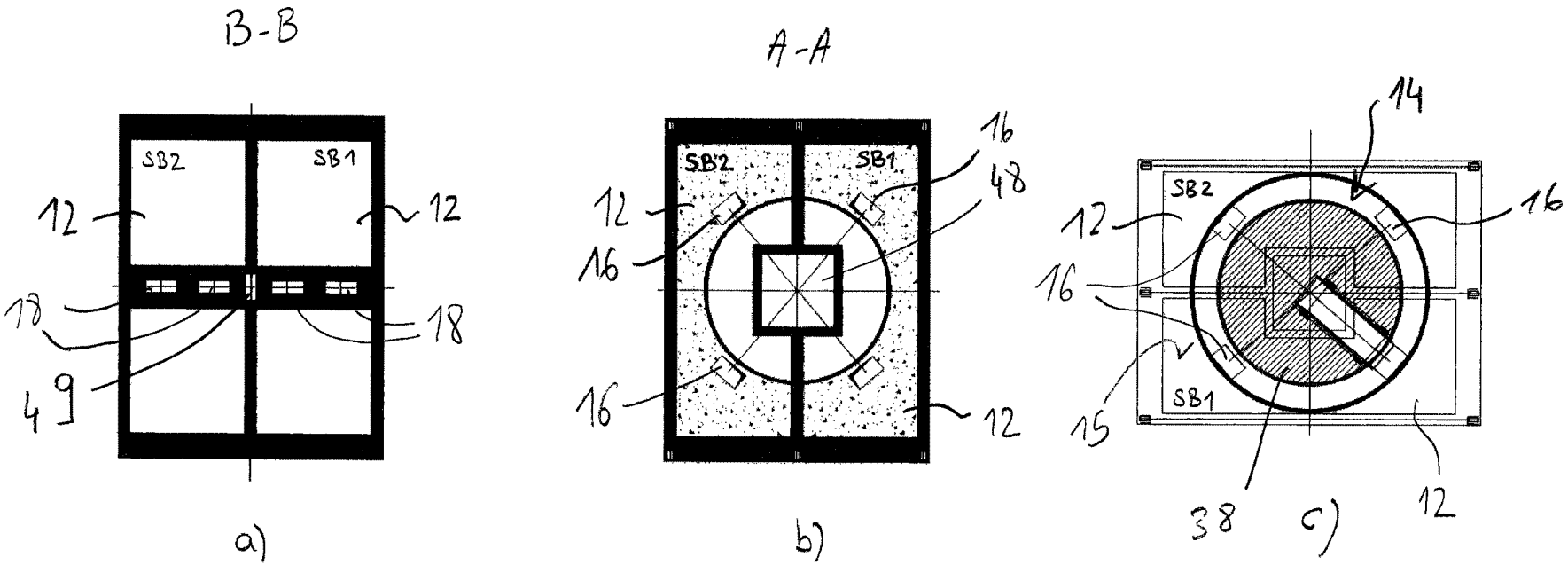
FIG. 3: is an elevation view of the stockhouse of FIG. 1.

FIGS. 1 to 3 illustrate an embodiment of the present stockhouse arrangement 10 for storing, measuring and preparing charge material for a metallurgical furnace, and in particular for a blast furnace plant.

The blast furnace area with such material storage arrangement is generally referred to as stockhouse; the terms "stockhouse", "stockhouse arrangement", "stockhouse system" and "material storage arrangement" will be used hereinafter indifferently.

The stockhouse 10 comprises a set of storage bins 12 that are arranged in a side-by-side manner to be filled by a material feeding device 14 associated therewith. The storage bins 12 have a general hopper-like form converging towards the lower ends thereof. The storage bins 12 have a large capacity, which is typically above 200 $m^3$, e.g. between 300 and 600 $m^3$, and even between 500 and 1000 $m^3$. The storage bins 12 are closed at their top by a cover 15, in which a feeding opening 16 is arranged; and have a narrow outlet 18 at their lower end (FIG. 3). In this embodiment, each bin 12 has two outlets 18. An extraction material gate 20 is generally associated with each outlet 18 to be able to close the respective outlet 18, or open it to allow material to flow down. The extraction material gate 20 may e.g. include a pair of cylindrical registers cooperating to define a flow opening of desired cross-section; other types of gate members may however be used.

The material feeding device 14 is positioned above the bins 12 in such a way as to be able to selectively fill each of the storage bins 12 with granular material. Raw material (the term "raw" is used herein to refer to the granular material before the screening in the material feeding device 14) is conveyed to the material feeding device 14 by a raw material feed system 22 that may be designed in any appropriate way. Here, the raw material feed system 22 comprises a belt conveyor 24 that allows bringing the raw materials above the material feeding device 14. A guide arrangement is provided to guide the granular material from the end of the belt conveyor 24 to the material feeding device 14, the granular material gravitally falling into the guide arrangement. More specifically, the guide arrangement comprises a collecting box 26 at the end of conveyor 24, which collects the material falling from the conveyor 24 and introduces it in a rotating feeding chute 27.

In the embodiment, one material feeding device 14 is associated with a pair of storage bins 12. The outlets 18 of the storage bins 12 are aligned along one conveyor line 30 of a BF charge conveying system (see FIG. 3*a*).

Two weighing hoppers 32 are arranged downstream of each storage bin 12, to receive and measure granular material from the storage bin 12 when the material gate 20 is open. Each weighing hopper 32 comprises an outlet associated with a feeding gate 34 (e.g. cylindrical registers or the like). The feeding gate 34 is above the conveyor line 30 and aligned therewith, so that, when open, measured amounts of material are discharged onto the conveyor line 30.

The general structure of the conveyors, bins, weighing hoppers and gates are well-known to those skilled in the art and will therefore not be described in detail.

It shall be appreciated that the material feeding device 14 is configured to screen raw granular material arriving from the raw material feed system 22 such that only material with desired granulometry is forwarded to the respective bin(s) 12.

The material feeding device 14, preferably centrally positioned above the bins 12, comprises a rotatable platform 38, e.g. of circular shape, that supports a screen unit 40 with vibrator. The platform 38 is supported in rotation on a circular runway (or alternatively on a central shaft) and can be selectively rotated by means of an electric motor and coupling gearing (not shown). In use, the platform is rotated depending on the bin 12 to be filled, in order to bring the screen unit 40 in alignment with the desired opening 16.

The screen unit 40 comprises an inlet area 42, in which material falls from the open end of chute 27. The screen unit 40 comprises a screening deck with one or more screens having a mesh size selected to be able to separate materials having a granulometry (grain size) above and below a desired size.

The screen of the screen unit 40 is thus vibrated, which allows screening and sizing the raw material into:

oversized material, i.e. material of interest having a grain size superior to the mesh size of the screen; and undersized material, i.e. material having a grain size inferior to the screen mesh size and falling there through.

The oversized material exits the screen unit 40 in the forward region thereof, through a discharging spout 41, and is expelled towards the selected bin 12, i.e. here in a generally radial direction having regard to the rotating platform 38. Since the screen unit 40 is pivoted to be radially aligned with a respective feeding opening 16 in the top of the bin 12, the material expelled through the discharging spout 41 falls into this feeding opening 16.

The undersized material, i.e. fines, is evacuated under the screen unit 40. A vibrating chute 44 is located below the screening deck of the screen unit 40, hence receiving the fines traversing the screen. In order to collect the fines separated in the screen unit 40, an opening 46 is provided in the rotary platform 38 at the location of the vibrating chute 44 and a collector bin 48 or chute is arranged below the rotary platform 38. This collector bin 48 also has a downwardly converging shape and is arranged between the neighbouring storage bins 12. The fine grained material collected in bin 48 falls on an auxiliary fines conveyor 50 through a bin outlet 49.

As it will be understood, the stockhouse arrangement 10 provides an improved design, where screened and sized granular material is stored in storage bins 12. This approach contrasts with the conventional stockhouse design where the raw material is stored in the bins without pre-treatment/screening, and a vibro-screen is arranged below each bin.

The invention provides a number of benefits:

the storage of sized material inside the bins 12 reduces material segregation issues;

the stockhouse construction is simplified, since only one vibrating screen unit 40 is required for a set of bins, instead of one per bin;

the measuring is also conveniently carried out since the stored material is ready for measuring;

fines are eliminated at a single location, directly at the top of the installation.

the handling of granular material is rationalised.

The internal storage area of the bins 12 is advantageously configured to prevent the free fall of material. This means that the bins are provided with internal guide elements, i.e. inside each bin, that provide a guide path for the granular material designed to slow the fall velocity, and leading them from the upper region of the bin to a median and/or lower region. Such a guide element, designated 52, may e.g. take the form of a chute, ladder or stairway, inclined or vertical, arranged in the bin to guide material entering the bin through its top opening towards the side walls in the median region of the bin.

Figure 4:
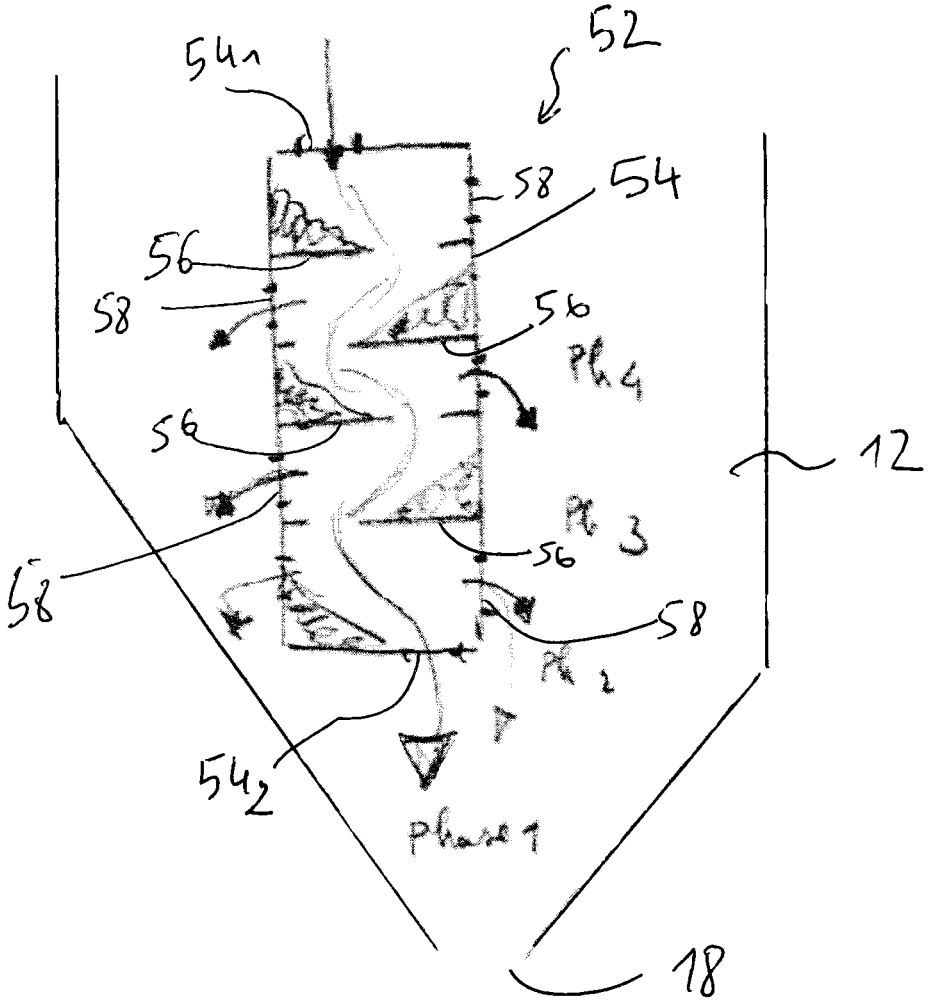
FIG. 4: is a sketch of one embodiment of a device for preventing free material fall.

Preferably, the guide element may be designed as a vertical rock ladder chute 52 as illustrated on FIG. 4. The rock ladder 52 is a modular pipe with vertical and lateral openings, by which material is discharged depending on the level of already piled material. The rock ladder comprises a vertical tube 54 having a top inlet opening $\mathbf{54}_1$ and a bottom outlet opening $\mathbf{54}_2$. A number of ledges (or shelfs) 56 are installed at various levels, to form a series of 'stone boxes'. Hence, the fall velocity of material entering the rock ladder 52 is slowed down by cascading back and forth between the ledges 56. Lateral openings 58 are provided at each level to feed up the bin in layers.

This rock ladder design is only one example of device for preventing free material fall and should not be regarded as limiting in any manner. Those skilled in the art may devise other kinds of devices for preventing free material fall.

The weighing hoppers 32 are also advantageously designed to avoid material degradation.

For example, diverter bars 60 may be arranged inside each weighing hopper 32, to create different flow channels avoiding the rat hole effect, which in conventional installations amplify the segregation on the main charging. During the filling of the weighing hopper 32, the diverter bars also avoid the free fall of the material—reducing the possible material degradation—and limit the centrifugal force on the grains which is the cause of the segregation.

As can be seen from FIGS. 1 and 2, diverter bars 60 are straight bars of square, round or shaped cross-section, distributed at a plurality of levels over the height of the weighing hopper 32, the diverter bars of two consecutive levels being arranged in a staggered manner.

It remains to be noted that although the present embodiment has been described for the sake of exemplification with a pair of bins, one material feeding device 14 can be centrally arranged with more bins, in particular 4 or 6. For example, referring to FIG. 3*a*), it can readily be seen that the material feeding device 14 could be installed for feeding 4 bins.

Finally another possible embodiment of the present stockhouse will be explained with reference to FIG. 5. In figure, only storage bins, designated 100.1 to 100.4 (or indifferently 100) are shown, with the material feeding device 102 above the bins 100. The material feeding device 102 is configured to screen raw granular material arriving from a raw material feed system such that only material with desired granulometry is forwarded to the respective bin(s) 100. In practice, the material feeding device 102 allows to selectively direct material with desired granulometry to one selected bin 100 of the set of bins.

The raw material feed system may be similar to the one shown in the previous embodiment (raw material feed system 22): arrow 104 illustrates the feeding of raw material to the material feeding device 110.

Also, although not shown and similarly to the previous embodiment, the storage bins 100 are closed at their top by a cover with a feeding opening. Each bin 100 has at least one outlet at its lower end with an extraction material gate. From there material is discharged in a weighing hopper, and then onto a conveyor line.

Referring now specifically to the material feeding device 102, one will recognize the screen unit 106 with vibrator. Here the screen unit 106 is static and centrally arranged with respect to the set of 4 storage bins 100; it cooperates with a movable, bi-directional conveyor belt 108 to fill in the respective bins 100. The oversized material, i.e. material of interest having a grain size superior to the mesh size of the screen unit, falls onto the movable conveyor belt 108.

Figure 5:
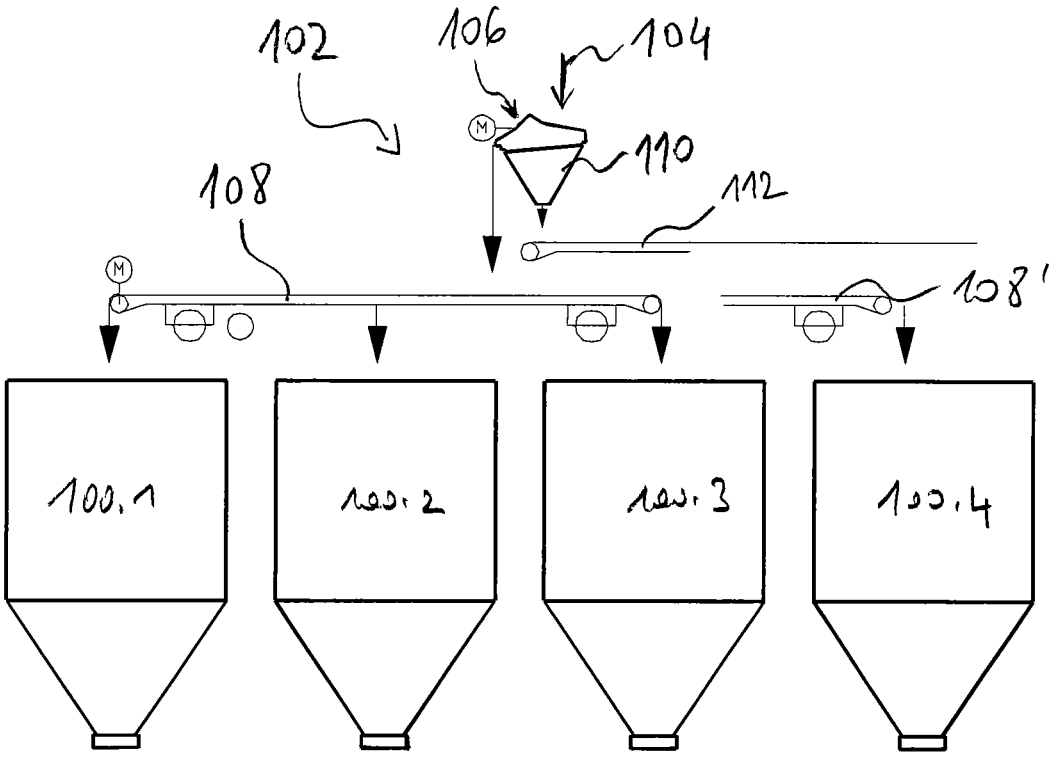
FIG. 5: is a diagram of another embodiment of the present stockhouse.

In the position shown in FIG. 5 the movable conveyor belt 108 is positioned on the left. The extremities 108.1 and 108.2 of the belt 108 are located above bin 100.1 and 100.3. Operating the belt 108 to rotate to as to convey material towards the left allows filling bin 100.1, whereas rotation in the opposite direction will cause material to fall into bin 100.3. The movable conveyor belt 108 can be alternatively brought on the right, as schematically represented by 108' (partial view). In this configuration, the extremities 108.1, 108.2 of the belt 108 are located above bin 100.2 and 100.4. Operating the belt 108 to rotate to as to convey material towards the left allows filling bin 100.2, whereas rotation in the opposite direction will cause material to fall into bin 100.4.

The fines, i.e. undersized material having a grain size inferior to the screen mesh size of the screening unit 106, fall there through into a funnel 110, by which they are delivered on a fines conveyor belt 112. The fines conveyor belt 112 is preferably laterally offset from conveyor belt 108 and carries the fines to a fines bin that may be located e.g. in a row parallel to bins 100, or in same row.

The above are only exemplary embodiments of the present stockhouse. Those skilled in the art may devise other configurations of intermediate conveyors for conveying the materials from the screening unit to the respective bin

The invention claimed is:

1. A stockhouse arrangement for a metallurgical furnace comprising:

a set of storage bins for granular material;

a material feeding device associated with said set of storage bins, the material feeding device being arranged above said set of storage bins and allowing to selectively fill each of the storage bins with granular material;

a raw material feed system to convey raw granular material to the material feeding device;

a respective weighing hopper arranged downstream of each storage bin and comprising an outlet associated with a feeding gate;

a charge conveying system for collecting and conveying material selectively discharged from the weighing hoppers through their respective feeding gates;

wherein said material feeding device is configured to screen raw granular material arriving from said raw material feed system such that only material with desired granulometry is forwarded to the respective bin(s), wherein said material feeding device comprises a screen unit receiving granular material from the raw material feed system, said screen unit comprising one or more screens of predetermined mesh size and being configured to filter out undersized granular material and forward oversized, desired material to the respective storage bins, wherein said material feeding device comprises intermediate conveyor means configured for transporting material with desired granulometry from the screen unit to a respective bin, wherein said intermediate conveyor means include a movable, bi-directional conveyor belt that receives material with desired granulometry from the screening unit;

the movable, bi-directional conveyor belt is arranged above the storage bins;

the movable, bi-directional conveyor belt is configured so that its ends can be aligned with respective storage bins in a row, to deliver material therein, and so that it can be moved along the row of storage bins.

2. The stockhouse arrangement according to claim 1, comprising a fines collecting bin associated with said material feeding device to collect undersized material screened out by the material feeding device before forwarding the material with desired size to the respective bin.

3. The stockhouse arrangement according to claim 2, wherein said material feeding device is generally centrally located with respect to said set of bins, with said fines collecting bin.

4. The stockhouse arrangement according to claim 3, wherein said material feeding device comprises a rotatable platform arranged above the set of storage bins, on which said screen unit is supported.

5. The stockhouse arrangement according to claim 4, wherein said fines collecting bin is arranged below said rotatable platform, to collect fines falling from below said screen unit.

6. The stockhouse arrangement according to claim 5, wherein said fines collecting bin has an outlet opening onto a fines conveyor.

7. The stockhouse arrangement according to claim 1, wherein said screen unit comprises a vibrator associated with the one or more screens.

8. The stockhouse arrangement according to claim 1, wherein said material feeding device (102) comprises means for transporting undersized material to the fines collecting bin.

9. The stockhouse arrangement according to claim 1, wherein each storage bin has its internal storage area configured to prevent free material fall.

10. The stockhouse arrangement according to claim 1, wherein each storage bin comprises one or more material guide elements forming paths for material from the bin's top region to a lower region, said path(s) being designed to reduce the velocity of the falling material.

11. The stockhouse arrangement according to claim 10, wherein the material guide elements may comprise a vertical or inclined chute, ladder, stairway, or a vertical rock ladder.

12. The stockhouse arrangement according to claim 1, wherein said weighing hoppers include diverter bars to avoid degradation and control segregation of materials inside said weighing hoppers.

13. The stockhouse arrangement according to claim 1, wherein each storage bin has its outlet associated with a material gate.

14. A blast furnace plant comprising a stockhouse arrangement according to claim 1, wherein the charge conveying system of said stockhouse arrangement cooperates with a top charging equipment arranged above the blast furnace.

* * * * *